US005191379A

United States Patent [19]

Manzer et al.

[11] Patent Number: 5,191,379

[45] Date of Patent: Mar. 2, 1993

[54] DEVICE FOR FLATTENING SINGLE SHEETS IN NON-MECHANICAL PRINTER AND PRINTER AND COPIER MEANS

[75] Inventors: Hans Manzer, Seefeld; Rudolf Seeberger, Lochham; Gerhard Klapettek, Giessen, all of Fed. Rep. of Germany

[73] Assignee: Siemens Aktiengesellschaft, Munich, Fed. Rep. of Germany

[21] Appl. No.: 576,391

[22] PCT Filed: Jun. 22, 1988

[86] PCT No.: PCT/DE88/00373

§ 371 Date: Nov. 26, 1990

§ 102(e) Date: Nov. 26, 1990

[87] PCT Pub. No.: WO89/08872

PCT Pub. Date: Sep. 21, 1989

[30] Foreign Application Priority Data

Mar. 14, 1988 [DE] Fed. Rep. of Germany ..... 3808477

[51] Int. Cl.[5] ..... G03G 15/20

[52] U.S. Cl. ..... 355/282; 162/271

[58] Field of Search ..... 355/309, 282; 271/161, 271/188, 209; 162/270, 271, 197; 156/442.1; 493/459

[56] References Cited

U.S. PATENT DOCUMENTS

| | | | |
|---|---|---|---|
| 3,861,863 | 1/1975 | Kudsi | 219/216 X |
| 4,505,695 | 3/1985 | Billings | 493/459 |
| 4,591,259 | 5/1986 | Kuo et al. | 355/309 |
| 4,627,718 | 12/1986 | Wyer | 162/271 X |
| 4,632,533 | 12/1986 | Young | 355/309 |
| 4,652,110 | 3/1987 | Sato et al. | 162/271 X |
| 4,864,124 | 9/1989 | Mirabella, Jr. et al. | 271/263 X |
| 4,926,358 | 5/1990 | Tani et al. | 355/311 X |
| 4,977,432 | 12/1990 | Coombs et al. | 162/271 X |
| 5,017,970 | 5/1991 | Sakata | 162/271 X |

OTHER PUBLICATIONS

Japanese Patent Abstract vol. 9, No. 226 (M-412) [1949], Sep. 12, 1985 (11) 60-82565(A).

Japanese Patent Abstract vol. 7, No. 275 (M-261) [1420], Dec. 8, 1983 (11) 58-152753(A).

Japanese Patent Abstract, vol. 10, No. 315 (M-529) [2371], Oct. 25, 1986, (11) 61-124463 (A).

Japanese Patent Abstract, vol. No. 12, No. 173, (P-706) [3020], May 24, 1988, (11) 62-283374 (A).

Japanese Patent Abstract, vol. No. 9, No. 177 (P-375) [1900] Jul. 23, 1985 (11) 60-50547 (A).

Japanese Patent Abstract, vol. No. 9, No. 239 (P-391) [1962] Sep. 25, 1985, (11), 60-91365 (A).

*Primary Examiner*—A. T. Grimley

*Assistant Examiner*—Nestor R. Ramirez

*Attorney, Agent, or Firm*—Hill, Steadman & Simpson

[57] ABSTRACT

In a single-sheet page printer for both-sided printing of recording media, a flattening device is provided for flattening the curled recording media resulting from pressure and temperature influences in the print fixing station of the printer. The flattening device deforms the recording media in the plastic domain so that the recording media are again lent a smooth and flat form. To this end, the recording medium is pulled over an edge by paper conveyor rollers opposite a pressing power exerted by spring elements and is thereby pulled taut and aligned. When the flattening device is arranged immediately following the fixing station, then it is proposed that the pressure roller be set back in the direction of the recording medium delivery relative to the position of the fixing drum. The geometrical design of a paper guide channel that immediately follows the fixing nip of the fixing means is such that the recording medium is thereby first curved in one direction and is subsequently curved in the opposite direction, so that a smooth and flat recording medium is ejected from the paper guide channel. Recording media of the greatest variety of paper qualities having different weights is flattened by the flattening device.

3 Claims, 2 Drawing Sheets

Figure 1:
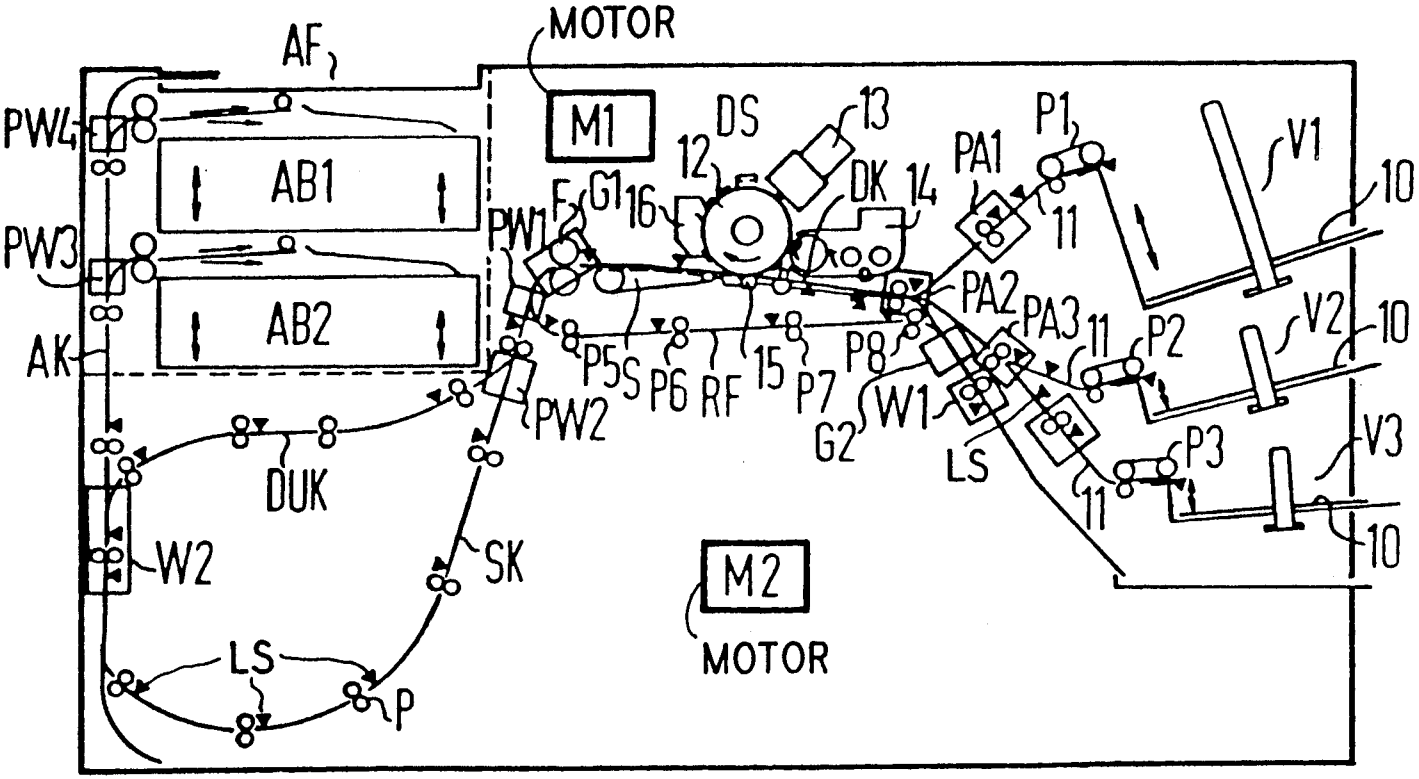

DEVICE FOR FLATTENING SINGLE SHEETS IN NON-MECHANICAL PRINTER AND PRINTER AND COPIER MEANS

The invention is directed to a non-mechanical printer or copier means having an intermediate carrier on which latent images of characters to be printed are generated dependent on print information and are developed into toner images with the assistance of a developer mix; a transfer printing station in which these toner images are transferred onto a recording medium; and a fixing means for fixing the toner images on the recording medium, the fixing means being composed of a motor-driven fixing drum and of a pressure roller that form a fixing nip for the recording medium, wherein the fixing drum and/or the pressure roller are heated.

Non-mechanical printers or copier means that work according to the electrostatic principle are generally known and have been successfully employed. In these means, toner images of the characters to be printed are generated on a recording medium, for example, on a paper web. This can occur, for example, in that electrophotographic or electrographic charge images are generated on a photoconductive, dielectric recording material, for example a drum. These charge images are developed in a developing station with the assistance of what are usually two-component toners composed of the actual toner particles forming the color and of ferromagnetic carrier particles. The images are then transferred in a transfer station onto an image-receiving material as an ultimate recording medium. In order to make the toner images smear-proof, they must subsequently be fused into the recording medium in a fixing station.

Fixing stations with which the toner images are fused into the recording medium are already known (U.S. Pat. No. 3,861,863). In these known fixing means, the recording medium passes through between two fixing drums whereof at least one is heated and these fixing drums forming a fixing gap. The fixing drums can therefore also be preceded by a means in the form of what is referred to as a pre-heating saddle for heating the recording medium.

In the fixing gap, the recording medium is heated under high pressing power to a temperature of, typically, 100° C. through 120° C. and the toner particles are thereby fused into the recording medium. In combination with this stressing, the curvature remaining in the recording medium is greatly dependent on the geometry of the paper guide immediately after departing the fixing gap. A curvature or arcing of the recording medium leads to increased conveying problems over the further course of the recording medium path. Particularly in the case of a duplex operation of the printer means wherein both-sided printing of the recording medium is possible, increased stripping problems derive therefrom at the electrophotographic intermediate image carrier and allocation deviations derive between the printing information and the recording medium. Moreover, there is the risk, on the one hand, of the non-uniform acceptance of the recording medium by further conveyor rollers, as a result whereof a crumpling risk cannot be made impossible, and, on the other hand, the stacking behavior is greatly deteriorated by a curvature of the recording media.

In duplex operation in such electrophotographic printers (page printers), the single sheet taken from a supply bin is first printed on its front side in the printing channel of the printer means, is then returned via a return channel into the input of the printing channel and is turned over in a turning means situated there. After being re-supplied into the printing channel, the back side of the single sheet is then printed. After this, the single sheet is deposited in an output bin via an output channel.

In order to maintain a continuous printing operation given a constant printing process speed, one or more sheets are continuously supplied to the printing channel and to the return means. The control of the printer then assigns the corresponding print image to the corresponding front, or respectively, back sides of the single sheet. The proper sequence in the output or, respectively, deposit is guaranteed in that all sheets to be printed are guided via the printing channel and the return channel including the turning means.

Given mixed printing jobs, i.e. given printing jobs that contain both simplex as well as duplex printing, it is disadvantageous that all sheets that are to be printed on only one side (simplex) are again conducted past the printing station. In the worst case, the processing speed of such a page printer is thereby reduced to nearly half of its capability that would otherwise be possible given an exclusive simplex operation. When, for example, a printing job has a majority of single sheets that are printed on only one side and otherwise has only a small number of single sheets to be printed on two sides, then the entire print job must be carried out in duplex operation nonetheless.

Page printers having single-sheet operation are constructed relatively complicated with respect to the paper conveying; moreover, the demanded tolerances in the paper channel are low. Since such page printers having printing speeds of 50 pages per minute or more are in use around-the-clock in shift operation, disturbances in the paper conveying as caused, for example, due to arcings impressed on the single sheets in fixing gaps have an especially disadvantageous effect.

JP-A-62 283 374 discloses a flattening means in combination with a fixing means, whereby the position of a pressure roller is offset relative to the position of the fixing means in order to eliminate arcings in the recording medium.

It is therefore an object of the invention to improve a non-mechanical printer or copier means of the species initially cited such that a flat recording medium that is free of arcings is present for further conveying after the conclusion of the actual printing event.

In a means of the species initially cited, this object is achieved by a non-mechanical printer or copier having the position of the pressure roller offset relative to the position of the fixing drum in the direction of the recording medium delivery by a horizontal distance; paper guide elements provided following the fixing nip, the paper guide elements forming a paper guide channel composed of a plurality of sections; and whereby the contour of the paper guide channel is designed such that, immediately after departing the fixing nip, the recording medium is curved in two following sections of the paper guide channel first in one direction and, subsequently, in the opposite direction, so that a flat and aligned recording medium is present for further conveying after departing the last section.

Advantageous developments of the invention are provided when that section of the paper guide channel arranged immediately following the fixing nip tapers in the direction of the following section, so that the recording medium is curved in the rotational sense of the fixing drum in the section. A further improvement provides that, proceeding from the preceding first section, the second section of the paper guide channel expands and the further course thereof is designed such the recording medium is deflected opposite the direction of the recording medium delivery.

In a preferred embodiment, the non-mechanical printer or copier means further provides that, proceeding from the preceding section, the section of the paper guide channel expands and the further course thereof is designed such that the recording medium is deflected opposite the direction of the recording medium delivery. A spring element under pre-stress may be provided in a paper guide channel between two following pair of paper conveyor rollers and, the spring element pressing the recording medium against a wall of the paper guide channel such that, while overcoming the moment of friction thereby produced, the recording medium is tautened over the edge of the paper guide channel and can be pulled off.

According to the perception on which the invention is based, arced recording media such as, for example, curved single sheets can be brought back into a straight form in non-mechanical printer means when they are deformed in the plastic domain.

The recording media are freed of arcings and curvatures in a simple way with the assistance of flattening devices that can be arranged either directly after the fixing station or preceding the turning means, so that the recording media can be forwarded and deposited without conveying problems after departing the flattening device.

In that the pressure roller is set back by a horizontal distance in the direction of the recording medium feed with respect to the fixing drum in the fixing station, a flattening means that is tightly constructed, saves device space and is simple because it requires no additional elements derives in combination with a paper guide channel optimized in terms of its curvature that immediately follows the fixing zone. The geometrical design of the paper guide elements forming the paper guide channel guarantees that the recording medium is first curved in the rotational sense of the fixing drum immediately after departing the fixing gap and is subsequently bent back opposite this curvature.

The deflection of the recording medium in the rotational sense of the fixing drum can be achieved in an especially simple way by a tapering of the paper guide channel immediately after the fixing gap, so that the recording medium is curved in an upward direction with respect to the fixing gap.

By establishing a section of the paper guide channel that is bent off U-shaped, the recording medium that was previously deflected and arced in the rotational sense of the fixing drum is subsequently arced in the opposite direction, on the one hand, and, on the other hand, a low space requirement for the overall flattening means derives due to such a greatly curved deflection.

Figure 2:
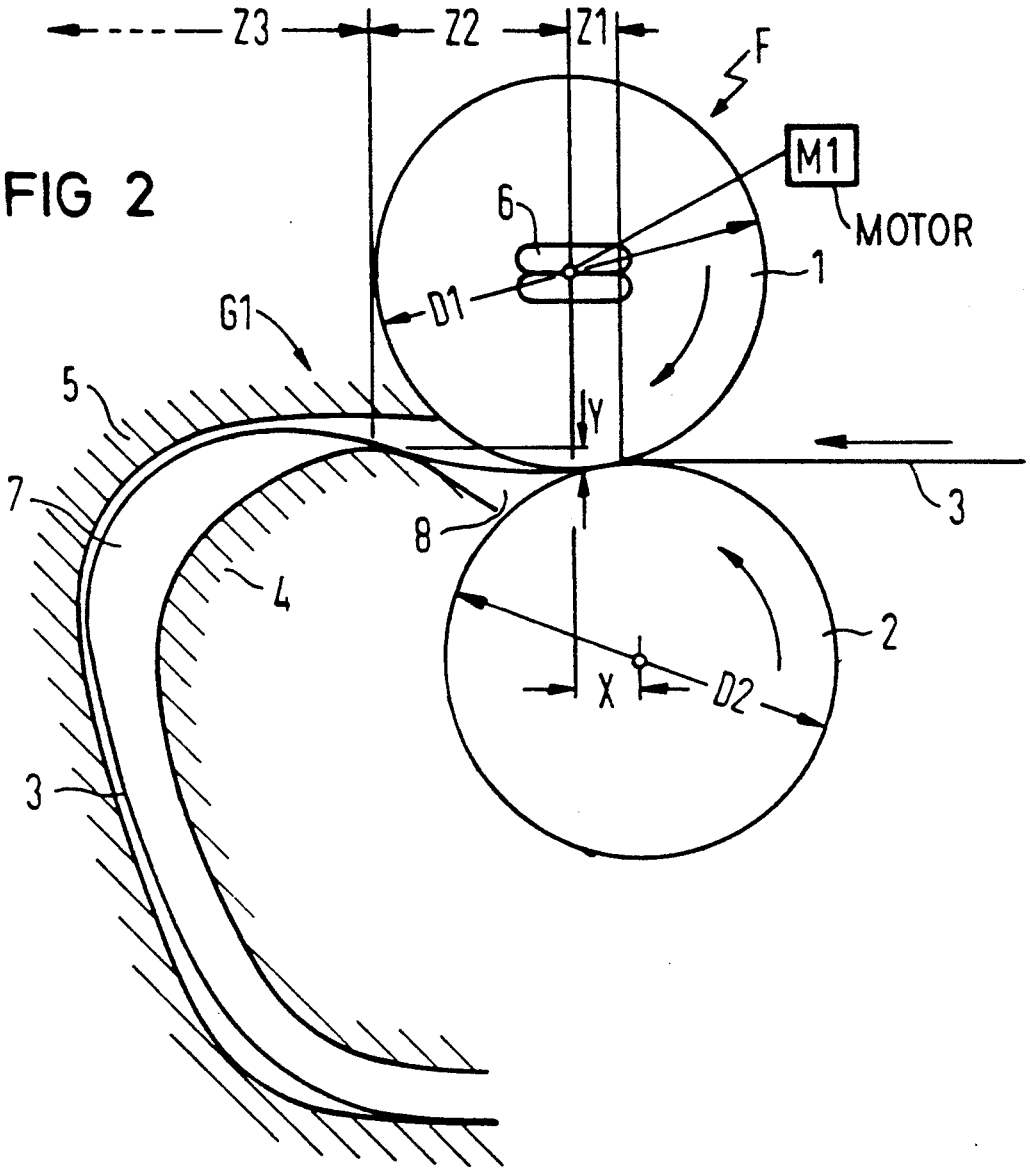
Figure 3:
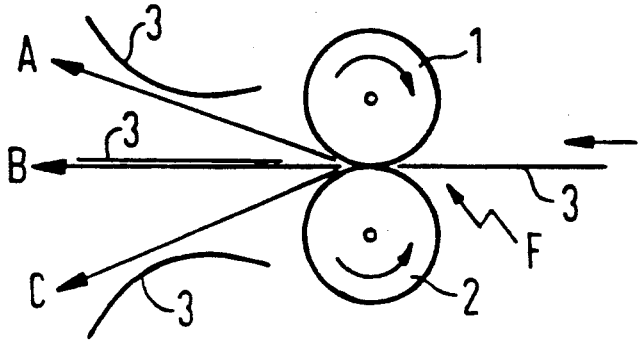

The invention shall be set forth in greater detail with reference to a number of exemplary embodiments shown in the figures. The figures are thereby only schematically executed in order to show the essence of the invention. The structure of the fixing drum, for example, can be taken from the aforementioned reference. Shown in detail are:

FIG. 1 a schematic, sectional view of the non-mechanical printer means for processing single sheets;

FIG. 2 a schematic illustration of a fixing means having a following paper guide channel for flattening single sheets;

FIG. 3 a schematic illustration of the curvature remaining in the recording medium dependent on the runout direction from the fixing zone.

The single-sheet page printer shown in FIG. 1 that works according to the principle of electro-photography contains three paper supply bins V1, V2 and V3 having different capacities for the acceptance of single sheets. The paper supply bins V1, V2 and V3 are constructed in a standard way and have a motor-driven bottom plate 10 that can be displaced in the direction of the arrows in accordance with the paper supply. A paper stack arranged in the paper supply bin is thereby lifted corresponding to the consumption of paper, so that the uppermost single sheet of the paper stack can be pulled from the paper stack via paper conveying elements P1, P2 and P3. The paper supply bins V1, V2, V3 are in communication with a printing channel DK of the printer means via paper delivery channel means 11. The printing channel DK contains the actual printing station DS having a photoconductive drive 12 serving as an intermediate carrier, having an illumination station 13 with an LED comb (not shown here) that can be driven character-dependent, having a developer station 14, having a transfer printing station 15 and having a cleaning station 16. The printing channel DK further contains paper-conveying elements in the form of a suction table S that circulates band-shaped and, at its input side, also contains a paper alignment means PA2 and a fixing station F composed of electrically heated heating drums that are electro motively driven and that, in a known way, thermally fixes a tone image that is transferred onto the recording medium (single sheet).

Paper conveying elements P5 through P8 in the form of motor-driven roller pairs that are arranged in a return channel RF are coupled to the printing channel DK at the input side and output side. The return channel RF also comprises a turning means W1 in which the single sheets are turned over before being resupplied to the printing channel DK in what is referred to as duplex operation.

Driven via a paper shunt PW1, the printing channel DK is followed by a paper transport channel system having a separate duplex channel DUK and a separate simplex channel SK that discharge into a common output channel AK. The single sheets printed on both sides are transported in the duplex channel DUK; the single sheets printed on one side are transported in the simplex channel SK. The duplex channel or, respectively, the simplex channel is driven via a shunt PW2. The simplex channel SK is fashioned as an elongated paper channel comprising paper conveying elements arranged therein. It can accept up to three single sheets behind one another and serves as a storage channel. A further turning means W2 is situated at the end of the duplex channel DUK. The turning means W2 connects the duplex channel DUK to the output channel AK.

The output channel AK comprises shunts PW3 and PW4 that conduct the single sheets into two deposit bins AB1 and AB2. A waste bin AF (copy tray) driveable via the shunt PW4 is also provided.

For identifying the position of the traversing single sheets and for controlling the paper conveying elements P, all paper channels comprise paper sensing sensors (shown as black triangles) that are composed of light barriers and continuously monitor the paper running.

Paper alignment means PA1 through PA3 are also arranged in the delivery channel 11 of the supply bins V1, V2, V3 and at the input of the printing channel DK, these paper alignment means serving the purpose of aligning the single sheets taken from the supply bins V1 through V3 in proper attitude before being printed printing channel DK and of supplying them to the printing station DS in aligned form.

All paper conveying elements P including the fixing station F and the photoconductive drum 12 are driven via two motors M1 and M2. The motor M1 thereby drives the paper conveying elements in the printing channel DK and in the admission region; the motor M2 drives the paper conveying elements in the return channel RF in the duplex channel DUK, in the simplex channel SK and in the output channel AK. All paper conveying elements (pairs of paper rollers) comprise electrically driveable couplings, for example, spring band couplings, and are in communication with the two allocated motors M1 or M2 via toothed belts that are not shown here for reasons of clarity.

Flattening devices G1, G2 for flattening the single sheets are also provided for the single sheet page printer of FIG. 1. It is thereby adequate to arrange one of the two flattening devices G1 or G2 for a friction-free conveying of the single sheets.

The flattening device G1 schematically shown in FIG. 2 is combined with the fixing station F and cooperates with it in the way set forth below.

The fixing station F contains a fixing drum 1 driven by the motor M1 and contains a pressure roller 2. Of the rollers 1, 2, at least the fixing drum is heated. To that end, one or more heat sources 6 are arranged in the inside of the fixing drum 1. The paper pressure roller 2 need not be heated; its function is usually comprised in pressing a recording medium 3, for example a single sheet, against the fixing drum 1.

The recording medium 3 proceeds into the fixing gap referenced with section Z1 between the fixing drum 1 and pressure roller 2 in the direction identified with the arrow symbol. The toner-covered side of the recording medium thereby faces toward the fixing drum 1. The toner is fused into the recording medium 3 in the section Z1 due to the heat transmitted from the fixing drum 1 onto the recording medium 3 and due to a high pressing power. In combination with this stressing of the recording medium 3, the curvature remaining in the recording medium 3 is greatly dependent on the geometry of paper guide elements 4, 5 directly following the fixing gap Z1 in addition to being dependent on the diameters D1 and D2 of the fixing drum 1 and of the pressure roller 2.

The schematic illustration in FIG. 3 shows this situation for three different run-out directions A, B, C of the recording medium 3 from the fixing gap Z1. Dependent on whether the recording medium 3 is deflected in an upward direction (run-out direction A) or in a downward direction (run-out direction C) with the assistance of following paper guide elements, a more or less pronounced curvature of the recording medium 3 derives in the respectively entered way. The run-out direction B assumes a relatively long, straight cooling distance immediately following the fixing station, this involving an additional space requirement.

In order to then guarantee that the recording medium 3 is lent no remaining curvature even given a space-saving and, thus, necessarily greatly curved runout region (section Z3 in FIG. 2), the position of the pressure roller 2 is offset relative to the position of the fixing drum 1 by a horizontal distance X in the direction of the recording medium delivery. As seen in a running direction of the recording medium 3, paper guide elements 4, 5 are provided following the rollers 1, 2, these paper guide elements 4, 5 forming a paper guide channel 7 that is bent essentially U-shaped for the recording medium 3. This paper guide channel 7 that can be divided into two sections Z2 and Z3 leads—dependent the position of a shunt (shunt PW1 in FIG. 1)—either to a deposit means for the printed recording media 3 or, when double-sided printing of the recording medium 3 is possible with the printer or copier means, also leads to a intermediate store or to the turning means W1 shown in FIG. 1. The fixing gap Z1 and, thus, the recording medium run-out 8 is immediately followed by a section Z2 in which the paper guide element 4 has a convexly arced contour such that the wall of the paper guide channel 7 proceeds elevated by a dimension Y relative to the horizontal position of the fixing gap Z1. The section Z2 of the paper guide channel 7 is followed by a section Z3 having a highly curved course that deflects the recording medium 3 in a downward direction and forwards it in a direction opposite that identified with the arrow symbol.

In combination with the rollers 1 and 2 offset by the horizontal distance X, the recording medium 3 is bent by a convexly arced wall of the paper guide element 4 that is elevated by the dimension Y, being bent immediately after departing the fixing gap Z1 in the section Z2 opposite the curvature in the following section Z3. Since the temperature gradient for the cooling of the recording medium 3 is extremely steep in the section Z2 and the evaporation of paper moisture occurs to a particular extent immediately after leaving the fixing gap Z1, the curvature in this section Z2 is assumed by the recording medium 3 to a great extent. Due to the curvature of the paper guide channel in the section Z3 that, as already mentioned, can be executed space-saving and narrow, the recording medium 3 is now bent back to a certain degree. Given proper matching of the distance X and the dimension Y, as well as taking the speed of the recording medium 3 into consideration, a straight non-curved recording medium 3 is present at the departure of the section Z3, this recording medium 3 being capable of being guided, further-conveyed and deposited over the farther course without problems.

In the arrangement of the invention, values of 2 through 20 mm for the dimension X as well as 2 through 15 mm for the dimension Y given a diameter D1=D2 of 30 through 70 mm for speeds of the recording medium 3 of 50 mm/s through 1000 mm/s prove especially advantageous.

Although other modifications and changes may be suggested by those skilled in the art, it is the intention of the inventors to embody within the patent warranted hereon all changes and modifications as reasonably and properly come within the scope of their contribution to the art.

We claim:

1. A non-mechanical printer or copier, comprising:

an intermediate carrier on which latent images of characters to be printed are generated dependent on print information and are developed into toner images with the assistance of a developer mix;

a transfer printing station in which these toner images are transferred onto a recording medium;

a fixing means for fixing the toner images on the recording medium, said fixing means comprising a motor-driven fixing drum and a pressure roller that together form a fixing nip for the recording medium and further comprising means for heating at least one of the fixing drum and the pressure roller;

a smoothing device for the recording medium that follows the fixing nip as seen in a conveying direction of the recording medium, said smoothing device eliminating the arcings of the recording medium impressed by the fixing means, the pressure roller being positioned offset by a predetermined horizontal distance relative to the position of the fixing drum in a direction opposite the conveying direction of recording medium;

said smoothing device including paper guide elements being provided following the fixing nip, said paper guide elements forming a paper guide channel composed of a plurality of sections; and a contour of the paper guide channel is such that, immediately after departing the fixing nip, the recording medium is curved in two following sections of the paper guide channel first in one direction and, subsequently, in an opposite direction, so that a flat and aligned recording medium is present for further conveying after departing the last section.

2. A non-mechanical printer or copier according to claim 1, wherein that section of the paper guide channel arranged immediately following the fixing nip tapers in the direction of the following section, so that the recording medium is curved in a rotational sense of the fixing drum in the section.

3. A non-mechanical printer or copier according to claim 1, wherein proceeding from a preceding first section, the second section of the paper guide channel expands and a further course thereof is such that the recording medium is deflected opposite the direction of the recording medium delivery.

* * * * *

UNITED STATES PATENT AND TRADEMARK OFFICE

CERTIFICATE OF CORRECTION

PATENT NO. : 5,191,379

DATED : March 2, 1993

INVENTOR(S) : Hans Manzer and Rudolf Seeberger and Gerhard Klappettek

It is certified that error appears in the above—identified patent and that said Letters Patent is hereby corrected as shown below:

On the title page and column 1.

IN THE TITLE: Delete "AND PRINTER".

Column 1, line 2, delete "AND PRINTER".

Signed and Sealed this

Twenty-third Day of November, 1993

*Attest:*

*Attesting Officer*

BRUCE LEHMAN

*Commissioner of Patents and Trademarks*